United States Patent [19]

Yamarik et al.

[11] 4,278,400

[45] Jul. 14, 1981

[54] COOLABLE ROTOR BLADE

[75] Inventors: George J. Yamarik, Vernon; James L. Levengood, West Hartford, both of Conn.

[73] Assignee: United Technologies Corporation, Hartford, Conn.

[21] Appl. No.: 939,767

[22] Filed: Sep. 5, 1978

[51] Int. Cl.[3] ..... F01D 5/18

[52] U.S. Cl. ..... 416/97 R; 415/115

[58] Field of Search ..... 416/97 A, 97 R, 96 A, 416/96 R; 415/115

[56] References Cited

U.S. PATENT DOCUMENTS

| | | | |
|---|---|---|---|
| 3,045,965 | 7/1962 | Bowmer | 416/97 |
| 3,240,468 | 3/1966 | Watts et al. | 416/96 A |
| 3,528,751 | 9/1970 | Quinones et al. | 416/96 |
| 3,628,885 | 12/1971 | Sidenstick | 416/97 |
| 3,782,852 | 1/1974 | Moore | 416/97 |
| 3,799,696 | 3/1974 | Redman | 415/115 |
| 3,807,892 | 4/1974 | Frei et al. | 416/97 |
| 3,885,609 | 5/1975 | Frei et al. | 415/115 |
| 3,994,622 | 11/1976 | Schultz et al. | 416/96 A |
| 4,022,542 | 5/1977 | Barbeau | 416/231 R |
| 4,073,599 | 2/1978 | Allen et al. | 416/97 |

FOREIGN PATENT DOCUMENTS

| | | | |
|---|---|---|---|
| 167979 | 8/1959 | Sweden | 416/97 |

OTHER PUBLICATIONS

Howmet Corporation Publication Received in Patent Office Apr. 6, 1977.

*Primary Examiner*—Everette A. Powell, Jr.
*Assistant Examiner*—A. N. Trausch, III
*Attorney, Agent, or Firm*—Robert C. Walker

[57] ABSTRACT

A rotor blade design capable of long term reliable operation in a high temperature environment is disclosed. Various cooling concepts adapted to preserve the mechanical properties of the blade material are developed. A cooling system for the blade is built around a multiple supply construction in which cooling medium from a first supply is mixed internally of the blade with cooling medium from a second supply.

3 Claims, 1 Drawing Figure

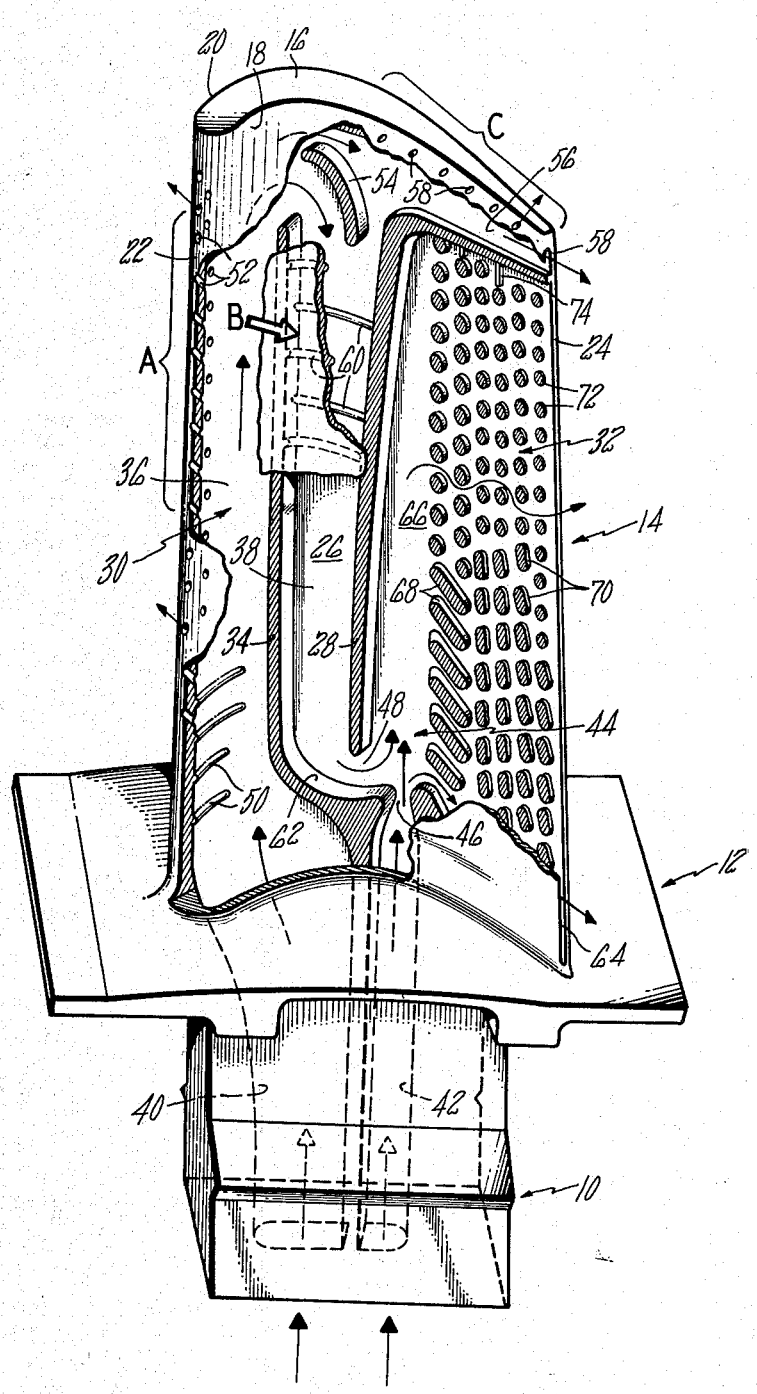
20
18
16
C
56
54
58
58
22
52
74
B
24
A
60
72
32
36
66
14
30
38
26
68
70
34
28
48
44
50
62
46
12
64
40
42
10

COOLABLE ROTOR BLADE

BACKGROUND OF THE INVENTION

1. Field of the Invention

This invention relates to rotor blades of high temperature turbo machinery, and more specifically to techniques for cooling such rotor blades.

2. Description of the Prior Art

Most relevant prior art is thought to be in the gas turbine engine field wherein airfoil surfaces of rotor blades are at times exposed to temperatures well in excess of two thousand five hundred degrees Fahrenheit (2500° F.). Limiting the metal temperature of such blades is extremely critical in order to preserve material strength in the face of high centrifugal loads and to prevent local material deterioration.

Technical literature is replete with intricate and complex approaches to cooling rotor blades. U.S. Pat. Nos. 3,799,696 to Redman entitled "Cooled Vane or Blade for a Gas Turbine Engine";3,782,852 to Moore entitled "Gas Turbine Engine Blades"; 3,994,622 to Schultz et al entitled "Coolable Turbine Blade"; 4,022,542 to Barbeau entitled "Turbine Blade"; and 4,073,599 to Allen et al entitled "Hollow Turbine Blade Tip Closure " are representative of prior art structures.

Not withstanding disclosures of the prior art, scientists and engineers continue to search for yet improved techniques and new combinations thereof which are able to extend the effective service life of rotor blades.

SUMMARY OF THE INVENTION

A primary aim of the present invention is to provide a turbine rotor blade having enhanced operating capabilities and extended life. Structure making effective, yet judicious use of limited amounts of cooling medium is sought. Specific objects are to modify the temperature of the cooling medium passing through the blade and to tailor cooling techniques employed to the regional blade heat loads.

According to the present invention, cooling medium directed through a leading edge flow region is mixed internally of the blade with cooling air flowed to a trailing edge flow region. In one specific embodiment, the air flowed to the trailing edge flow region is the motive fluid for an ejector drawing cooling air from the leading edge flow region.

A primary feature of the present invention is structure internally of the blade for diluting relatively high temperature cooling air from the leading edge flow region prior to utilization in the trailing edge flow region. In one specific embodiment, an ejector powered by relatively cool air draws the relatively high temperature cooling air from the leading edge region into the trailing edge flow region. In other embodiments of the invention, the leading edge is cooled by combined convective and film cooling techniques. Trip strips near the platform region cause increased convective cooling as cooling air is flowed thereby: leading edge cooling holes cause a film of cooling air to be deposited over the outward surfaces of the airfoil section. Additional trip strips are disposed on the side walls of the airfoil section in a mid-region of the blade. Tip holes on the pressure side wall cause cooling medium to be flowed over the trailing edge portion of the tip. Desired distribution of cooling medium at the trailing edge of the airfoil section is enabled by the selected disposition of obstructing pedestals, oblong pedestals, and circular pedestals.

A principal advantage of the present invention is extended blade life. Effective cooling of the blade material is enabled by combining cooling techniques which are specifically tailored to the regional heat load characteristics of the blade. Positive cooling flow though the blade is insured in one series of embodiments by providing an ejector adapted to draw cooling medium from the leading edge flow region of the blade. Relatively high temperature cooling medium from the leading edge flow region of the blade is diluted by the addition of new cooling medium to the trailing edge flow region of the blade. The service life of protective coatings conventionally applied to surfaces of the airfoil sections is extended by the improved blade cooling. The mechanical properties of the blade material are preserved by limiting the average temperature of the blade material.

The foregoing, and other objects, features and advantages of the present invention will become more apparent in the light of the following detailed description of the preferred embodiment thereof as shown in the accompanying drawing.

BRIEF DESCRIPTION OF THE DRAWING

FIG. 1 is a simplified perspective view of a turbine rotor blade including cut-away portions revealing the intricate cooling mechanisms employed by the present invention.

DETAILED DESCRIPTION

A simplified perspective view of a rotor blade is shown in the drawing. The rotor blade has a root section 10, a platform section 12 and an airfoil section 14. The root section is adapted for attachment to the rotor of a turbo-machine. The platform section is adapted to form a portion of the inner wall of the flow path for working medium gases in a turbomachine. The airfoil section is adapted to extend outwardly across the flow path for the working medium gases and has a tip 16 at its most outward end. The airfoil section principally comprises a pressure side wall 18 and a suction side wall 20 which are joined at a leading edge 22 and a trailing edge 24 to form an internal cavity 26 therebetween. In the drawing, portions of the pressure side wall are cut-away to reveal intricate internal structure and passages between the pressure side wall and the suction side wall. A rearward baffle 28 divides the internal cavity into a leading edge flow region 30 and a trailing edge flow region 32. A forward baffle 34 divides the leading edge flow region into an outward passage 36 and an inward passage 38. A forward conduit 40 extends through the root and platform sections of the blade and is adapted to flow cooling medium gases to the outward passage of the leading edge flow region. A rearward conduit 42 extends through the root and platform sections of the blade and is adapted to flow cooling medium gases to the trailing edge flow region.

In the embodiment illustrated, an ejector 44 is formed in the trailing edge flow region at the outward end of the rearward conduit. An ejector nozzle 46 at the outward end of the rearward passage is adapted to accelerate cooling medium gases discharging from the conduit. The discharged gases flow across an aperture 48 at the inward end of the inward passage of the leading edge flow region.

In the leading edge flow region a plurality of first trip strips 50 extend from the interior surfaces of the pressure side wall and the suction side wall at the leading edge of the blade. A multiplicity of leading edge holes 52 penetrate the leading edge of the airfoil section. In the embodiment illustrated, the first trip strips are confined to the inward portion of the outward flow passage 36 and three rows of holes are confined to the mid and outward portions of the passage. A turning vane 54 at the outward end of the inward passage 38 is adapted to divide leading edge flow between the inward passage 38 and a tip passage 56. Tip cooling holes 58 leading from the passage 56 are adapted to flow cooling air over the trailing edge portion of the tip. Second trip strips 60 extend from the interior surface of the side walls in the outer region of the inward passage. A base portion 62 of the forward baffle has a rounded contour adapted to turn medium gases from the leading edge flow region in the outward direction as they pass through the aperture 48.

The trailing edge flow region has a discharge slot 64 extending across the trailing edge 24 of the blade. Cooling medium gases entering the trailing edge flow region are caused to flow outwardly along a trailing edge passage 66. The cross sectional area of the passage 66 is reduced gradually toward the tip 16 of the blade. A multiplicity of obstructing pedestals 68, oblong pedestals 70 and circular pedestals 72 span the cavity in the trailing edge flow region between the pressure side wall and the suction side wall. One or more third trip strips 74 extend from the walls of the airfoil section in the outward portion of the trailing edge flow region.

The concepts of the present invention are specifically tailored to provide effective heat transfer characteristics in regions of the blade having the highest heat load. Principally, the high heat load regions of the blade include the mid-span region (A) of leading edge A, the mid-span region (B) of the pressure and suction side walls B, and the tip region (C) near the trailing edge.

Multiple use of the cooling medium is employed to take full advantage of the medium cooling capacity. For example, in the outward passage 36 of the leading edge region the cooling medium first convectively cools the blade near the platform section and subsequently film cools the mid-span and tip regions of the blade. The trip strips 50 extend from the pressure side wall 18 around the leading edge 22 to the suction side wall 20. Each trip strip adds turbulence to the boundary layer and approximately doubles the cooling air heat transfer coefficient in that area. Immediately outward of the trip strips 50, the leading edge holes 52 cause a portion of the cooling medium in the passage to be flowed over the outer surface of the leading edge. Film cooling of the blade leading edge results. In the embodiment illustrated, three (3) rows of holes having a twenty thousandths of an inch (0.020 in. ) nominal diameter are employed. The combination of trip strips and leading edge holes decreases the number of holes required to achieve adequate cooling of the leading edge. Film cooling holes need not be placed at the inward portion of the blade span.

The portion of the leading edge cooling air not flowed over the leading edge for film cooling is divided at the turning vane 54. A first portion is flowed via the tip passage 56 through the tip cooling holes 58 and over the trailing edge portion of the blade tip. The remaining portion of the leading edge cooling air is turned inwardly by the vane 54 and flowed through the inward passage 38. Second trip strips 60 extend from the side walls of the inward passage to again increase the cooling air heat transfer coefficient in that region. The strips 60 may be confined to only the suction side wall or only the pressure side wall, depending upon the heat loads in that region.

Upon discharge from the inward passage the temperature of the cooling air is modified by diluting that air with fresh, lower temperature air from the rearward conduit 42. In the embodiment shown, the air from the inward passage and the air from the rearward conduit are mixed in the ejector 44. An ejector nozzle 46 at the end of the conduit 42 accelerates the cooling medium flow therethrough. The accelerated medium flows across the aperture 48 drawing the higher temperature medium from the inward passage. The rounded contour at the base 62 of the forward baffle 34 reduces flow losses as the medium from the inward passage is drawn outwardly into the trailing edge passage 66.

In the trailing edge flow region 32, the cooling medium is flowed outwardly through the tapered trailing edge passage 66. Obstructing pedestals 68 prevent wasteful discharge of cooling medium at the trailing edge near the platform sections where heat loads are relatively low. To further discourage cooling medium flow in this lower heat load region, the width of the trailing edge slot 64 is approximately nineteen thousandths of an inch (0.019 in.) over the first half of the blade span and approximately twenty-three thousandths of an inch (0.023 in.) over the second half of the blade span.

Circular pedestals 72 are placed where lesser obstructions to flow are desired. Third trip strips 74 are employed in the embodiment shown to further increase cooling air heat transfer coefficients in the trailing edge flow region.

Approximately two-thirds ($\frac{2}{3}$) of the air required to cool the blade is admitted through the forward conduit 40 and approximately one-third of the air required to cool the blade is admitted through the rearward conduit 42. About forty-five percent (45%) of the forward conduit air is discharged through the leading edge holes 52 and about forty percent (40%) is drawn through the aperture 48. The remainder is flowed through the tip holes 58.

Although the invention has been shown and described with respect to preferred embodiments thereof, it should be understood by those skilled in the art that various changes and omissions in the form and detail thereof may be made therein without departing from the spirit and scope of the invention .

Having thus described typical embodiments of our invention, that which we claim as new and desire to secure by Letters Patent of the United States is:

1. A coolable rotor blade structure of the type including an airfoil section having a leading edge and a trailing edge and having a pressure side wall and a suction side wall forming a leading edge flow region and a trailing edge flow region therebetween, and including a root section having means extending therethrough for flowing cooling air to the leading edge flow region and means extending therethrough for flowing cooling air to the trailing edge flow region, wherein said leading edge flow region and said trailing edge flow region are communicatively joined at a point such that at least a portion of the cooling air flowable to said leading edge flow region is dischargeable into said trailing edge flow region, wherein the improvement comprises:

an ejector at said point of communicative juncture between the leading edge flow region and the trailing edge flow region for drawing the flow of cooling air through the leading edge region.

2. The invention according to claim 1 which further includes:

a baffle between the pressure side wall and the suction side wall for separating the leading edge flow region from the trailing edge flow region including an aperture therein through which said cooling air of the leading edge region is flowable; and a nozzle at the end of said means for flowing cooling air to the trailing edge flow region extending through the root section and through which cooling air is flowing to the trailing edge region said aperture and said nozzle forming the ejector at said point of communicative juncture.

3. The invention according to claim 1 or 2 which further includes a trailing edge slot having a greater width at its outer end than at its inner end for discharging cooling air from the trailing edge flow region.

* * * * *

UNITED STATES PATENT AND TRADEMARK OFFICE

CERTIFICATE OF CORRECTION

PATENT NO. : 4,278,400

DATED : July 14, 1981

INVENTOR(S) : George J. Yamarik and James L. Levengood

It is certified that error appears in the above-identified patent and that said Letters Patent are hereby corrected as shown below:

Col. 2, line 7 "though" should be -- through --

Signed and Sealed this

Tenth Day of November 1981

[SEAL]

*Attest:*

GERALD J. MOSSINGHOFF

*Attesting Officer*

*Commissioner of Patents and Trademarks*